US009088062B2

(12) United States Patent
Ito

(10) Patent No.: US 9,088,062 B2
(45) Date of Patent: Jul. 21, 2015

(54) DIELECTRIC WAVEGUIDE FILTER

(75) Inventor: Kazuhiro Ito, Tsurugashima (JP)

(73) Assignee: TOKO, INC., Saitama (JP)

( * ) Notice: Subject to any disclaimer, the term of this patent is extended or adjusted under 35 U.S.C. 154(b) by 181 days.

(21) Appl. No.: 13/418,040

(22) Filed: Mar. 12, 2012

(65) Prior Publication Data

US 2012/0229233 A1 Sep. 13, 2012

(30) Foreign Application Priority Data

Mar. 11, 2011 (JP) ..... 2011-053876

(51) Int. Cl.
*H01P 1/20* (2006.01)
*H01P 7/10* (2006.01)
*H01P 1/208* (2006.01)

(52) U.S. Cl.
CPC ..... *H01P 1/2084* (2013.01); *H01P 1/2088* (2013.01); *H01P 1/2002* (2013.01); *H01P 7/10* (2013.01)

(58) Field of Classification Search
CPC .... H01P 1/2002; H01P 1/7065; H01P 1/2088
USPC ..... 333/208, 209, 212, 219.1
See application file for complete search history.

(56) References Cited

U.S. PATENT DOCUMENTS 6,002,306 A 12/1999 Arakawa
6,133,808 A 10/2000 Arakawa
6,556,106 B1 4/2003 Sano et al.
6,563,402 B2 * 5/2003 Kundu ..... 333/202
2002/0039058 A1 4/2002 Sano et al.

FOREIGN PATENT DOCUMENTS

CN 1266289 9/2000
JP 2000-286606 10/2000
KR 10 2010 0001970 1/2010

OTHER PUBLICATIONS

J. Brian Thomas, "Cross-Coupling in Coaxial Cavity Filters—A Tutorial Overview", IEEE Transactions on Microwave Theory and Techniques, vol. 51, No. 4, pp. 1368-1376, Apr. 2003.

* cited by examiner

*Primary Examiner* — Robert Pascal
*Assistant Examiner* — Gerald Stevens
(74) *Attorney, Agent, or Firm* — Cozen O'Connor

(57) ABSTRACT

[OBJECT]
It is an object to provide a dielectric waveguide filter with attenuation poles, which is capable of suppressing deterioration in a high band-side attenuation characteristic with respect to a low band-side attenuation characteristic.
[SOLUTION]
A dielectric waveguide filter comprises a plurality of dielectric waveguide resonators each having a rectangular parallelepiped-shaped dielectric block, periphery of which is covered by a conductor film. The dielectric waveguide resonators are configured to form a main coupling path, and a sub coupling path bypassing a part of the main coupling path. The part of the main coupling path bypassed by the sub coupling path includes at least one capacitive coupling path.

3 Claims, 11 Drawing Sheets

-- Prior Art --

-- Prior Art --

-- Prior Art --

-- Prior Art --

-- Prior Art --

-- Prior Art --

DIELECTRIC WAVEGUIDE FILTER

TECHNICAL FIELD

The present invention relates to a dielectric waveguide filter having a plurality of dielectric waveguide resonators coupled together.

BACKGROUND ART

In order allow wireless communication channels to be set adjacently to each other as close as possible so as to effectively utilize frequency resources, a base station for mobile phones or the like requires a bandpass filter having a steep attenuation characteristic for preventing inter-channel interference. If a bandpass filter using a small-size and lightweight dielectric waveguide resonator, called a "dielectric waveguide filter", is used in place of a large and heavy metal cavity resonator, the base station can be reduced in size and weight. It also becomes possible to facilitate a reduction in cost of the base station.

The dielectric waveguide filter is constructed by combining a plurality of dielectric waveguide resonators each having a dielectric block peripherally covered by a conductor film and partially provided with a coupling window through which the dielectric is exposed. Adjacent ones of the dielectric waveguide resonators are arranged in close contact relation, and a mutual coupling between the adjacent dielectric waveguide resonators is electromagnetically established through the coupling window. A coupling window having a long-side direction coincident with a direction of electric field is called an "inductive window", and adapted to inductively couple adjacent dielectric waveguide resonators. A coupling window having a long-side direction perpendicular to a direction of electric field is called a "capacitive window", and adapted to capacitively couple adjacent dielectric waveguide resonators.

Generally, to make an attenuation characteristic of a bandpass filter steep, the number of resonators constituting the filter may be increased.

However, an unloaded Q of a dielectric waveguide resonator is less than an unloaded Q of a metal cavity resonator. Thus, if the number of dielectric waveguide resonators in a dielectric waveguide filter is increased, an insertion loss in a passband of the filter will be increased. Therefore, a technique of forming attenuation poles by means of cross-coupling (bypass-coupling) is employed to obtain a filter having a low insertion loss and a steep attenuation characteristic, without increasing the number of dielectric waveguide resonators.

As a specific example of this conventional technique, a dielectric waveguide filter comprising four dielectric waveguide resonators and having attenuation poles formed by means of cross-coupling is disclosed in FIG. 5 of JP 2000-286606 A.

FIG. 8A is an exploded perspective view illustrating a conventional dielectric waveguide filter with attenuation poles using cross-coupling, and FIG. 8B is an equivalent circuit diagram corresponding to FIG. 8A. As illustrated in FIGS. 8A and 8B, the conventional dielectric waveguide filter 8 comprises six dielectric waveguide resonators 81 to 86 each having a rectangular parallelepiped-shaped dielectric block peripherally covered by a conductor film. The dielectric waveguide resonator 81 has an inductive window L81 for input, and the dielectric waveguide resonator 86 has an inductive window L87 for output. The dielectric waveguide resonators 81 to 86 are coupled in series through respective inductive windows L82 to L86, and a mutual coupling between the dielectric waveguide resonators 82, 85 is established through a capacitive window C80 in a cross (bypass)-coupling manner.

In this dielectric waveguide filter 8, a coupling path passing through the dielectric waveguide resonators 81, 82, 83, 84, 85, 86, and a coupling path passing through the dielectric waveguide resonators 81, 82, 85, 86, will hereinafter be referred to as "main coupling path" and "sub coupling path", respectively.

In the dielectric waveguide filter, attenuation poles are formed by adjusting a transmission phase and a transmission amplitude in the sub coupling path, with respect to the main coupling path.

FIG. 9A is a graph illustrating a change in transmission phase to frequency in each of an inductive coupling path and a capacitive coupling path, wherein the solid line and the dashed line indicate a transmission phase in the inductive coupling path and a transmission phase in the capacitive coupling path, respectively. FIG. 9B is a graph illustrating a change in transmission phase to frequency in a dielectric waveguide resonator.

As illustrated in FIG. 9A, the transmission phase in each of the inductive coupling path and the capacitive coupling path is approximately constant irrespective of frequencies. The inductive coupling path has a function of advancing a signal phase by about 90 degree, and the capacitive coupling path has a function of delaying a signal phase by about 90 degrees.

On the other hand, as illustrated in FIG. 9B, the transmission phase in the dielectric waveguide resonator is delayed by 90 degrees on a low band side with respect to a resonant frequency $f_0$ of the dielectric waveguide resonator, and advanced by 90 degrees on a high frequency side of a pass band (high band side) with respect to the resonant frequency $f_0$.

Generally, in cases where a plurality of dielectric waveguide resonators are coupled in series, an inclination of the transmission phase becomes steeper as a path has a larger number of dielectric waveguide resonators.

Based on the above characteristics, a filter is designed such that a plurality of dielectric waveguide resonators are connected together while combining an inductive coupling path and a capacitive coupling path, and a signal transmitted through a main coupling path and a signal transmitted through a sub coupling path become opposite in phase and identical in amplitude.

For example, the dielectric waveguide filter 8 illustrated in FIG. 8A is designed such that a signal transmitted through the main coupling path and a signal transmitted through the sub coupling path become opposite in phase, on both of the low band and high band sides.

Such a design method is disclosed in J. Brain Thomas, "Cross-Coupling in Coaxial Cavity Filters-A Tutorial Overview", IEEE TRANSACTIONS ON MICROWAVE THEORY AND TECHNIQUES, VOL. 51, NO. 4, April 2003, P1368.

FIG. 10A is a graph illustrating respective transmission amplitude-frequency characteristic in the main and sub coupling paths of the dielectric waveguide filter 8 illustrated in FIG. 8A, wherein the solid line and the dashed line represent the main coupling path and the sub coupling path, respectively. FIG. 10B is a graph illustrating a transmission amplitude-frequency characteristic of the dielectric waveguide filter 8, which is obtained by synthesizing respective transmission amplitudes illustrated in FIG. 8A and phases in the main and sub coupling paths. In FIGS. 10A and 10B, a center frequency of the dielectric waveguide filter 8 is the resonant frequency $f_0$, and two attenuation poles $f_a$, $f_b$ are formed at frequencies at which the transmission amplitudes in the main and sub coupling paths are coincident with each other.

In FIGS. 10A and 10B, a distance between the attenuation pole $f_b$ and the resonant frequency $f_0$ is greater than a distance between the attenuation pole $f_a$ and the resonant frequency $f_0$. This is caused by the following low-pass filter-like property of the capacitive coupling path: a transmission amplitude becomes smaller along with an increase in frequency.

FIG. 11 is a graph illustrating respective transmission amplitude-frequency characteristic in a capacitive coupling path and an inductive coupling path, wherein the solid line and the dashed line represent the inductive coupling path and the capacitive coupling path, respectively. As illustrated in FIG. 11, a transmission amplitude in the inductive coupling path gradually becomes larger along with an increase in frequency, and a transmission amplitude in the capacitive coupling path gradually becomes smaller along with an increase in frequency. This means that the inductive coupling path has a high-pass filter-like property, and the capacitive coupling path has a low-pass filter-like property.

SUMMARY OF THE INVENTION

Problem to be Solved by the Invention

In the conventional dielectric waveguide filter, the inductive coupling path having a high-pass filter-like property is included in the main coupling path in a larger number than in the sub coupling path, so that an attenuation amplitude in the main coupling path exhibits a characteristic that a high band-side attenuation slope becomes gentler than a low band-side attenuation slope, Therefore, a high band-side point at which the transmission amplitudes in the main and sub coupling paths are coincident with each other is shifted toward a high-frequency side. This causes a problem that the high band-side attenuation pole becomes farther away from the center frequency than the low band-side attenuation pole, and a high band-side attenuation characteristic of the dielectric waveguide filter becomes gentler than a low band-side attenuation characteristic thereof.

In order to solve the above problem, the present invention provides a dielectric waveguide filter which has a plurality of dielectric waveguide resonators connected each other, each having a rectangular parallelepiped-shaped dielectric block, periphery of which is covered by a conductor film. The dielectric waveguide filter comprises a main coupling path coupling the plurality of dielectric waveguide resonators in series, and at least one sub coupling path formed by bypassing a part of the main coupling path, wherein the part of the main coupling path bypassed by the sub coupling path includes at least one capacitive coupling path.

Preferably, in the dielectric waveguide filter of the present invention, the capacitive coupling path has a dielectric plate inserted therein, wherein the dielectric plate has a dielectric constant greater than that of the dielectric waveguide resonator.

In one aspect of the present invention, a capacitive coupling path is used in the part of the main coupling path, so that it becomes possible to provide a dielectric waveguide filter in which a high band-side attenuation pole comes close to a center frequency, and an attenuation characteristic become steep on both of high band and low band sides.

In another aspect of the present invention, a dielectric plate having a dielectric constant greater than that of the dielectric waveguide resonator is inserted in the capacitive coupling path, so that it becomes possible to increase a distance between opposed sides of the capacitive window in a short-side direction thereof to provide a dielectric waveguide filter in which electric discharge is less likely to occur in the capacitive window even when a large amount of electric power is input into the dielectric waveguide filter.

DESCRIPTION OF EMBODIMENTS

Figure 1A:
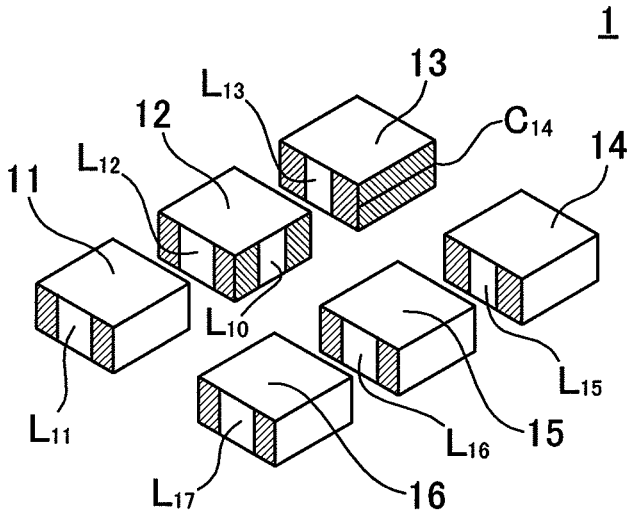
FIG. 1A is an exploded perspective view of a first embodiment of the present invention.
Figure 1B:
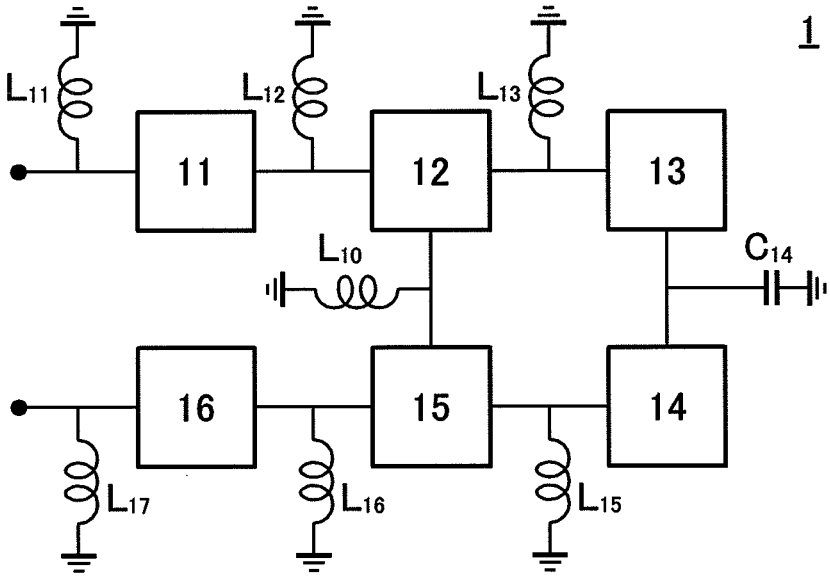
FIG. 1B is an equivalent circuit diagram corresponding to FIG. 1A.

Using to the drawings, embodiments of the present invention will now be described below. FIG. 1A is an exploded perspective view of a dielectric waveguide filter according to a first embodiment of the present invention, and FIG. 1B is an equivalent circuit diagram corresponding to FIG. 1A. As illustrated in FIGS. 1A and 1B, the dielectric waveguide filter 1 comprises six dielectric waveguide resonators 11 to 16 each having a rectangular parallelepiped-shaped dielectric block peripherally covered by a conductor film. The dielectric waveguide resonator 11 has an inductive window L11 for input, and the dielectric waveguide resonator 16 has an inductive window L17 for output. The dielectric waveguide resonators 11 to 13 are coupled in series through inductive windows L12, L13, and the dielectric waveguide resonators 14 to 16 are coupled in series through inductive windows L15, L16. A mutual coupling between the dielectric waveguide resonator 13 and the dielectric waveguide resonator 14 is established through a capacitive window C14, and a mutual coupling between the dielectric waveguide resonator 12 and the dielectric waveguide resonator 15 is established through an inductive window L10.

Thus, the dielectric waveguide filter of the present invention has a main coupling path passing through the dielectric waveguide resonators 11, 12, 13, 14, 15, 16, and a sub coupling path passing through the dielectric waveguide resonators 11, 12, 15, 16. Specifically, the sub coupling path is formed by bypassing the dielectric waveguide resonators 13, 14, and the part of the main coupling path bypassed by the sub coupling path includes a capacitive coupling window C14.

Figure 2A:
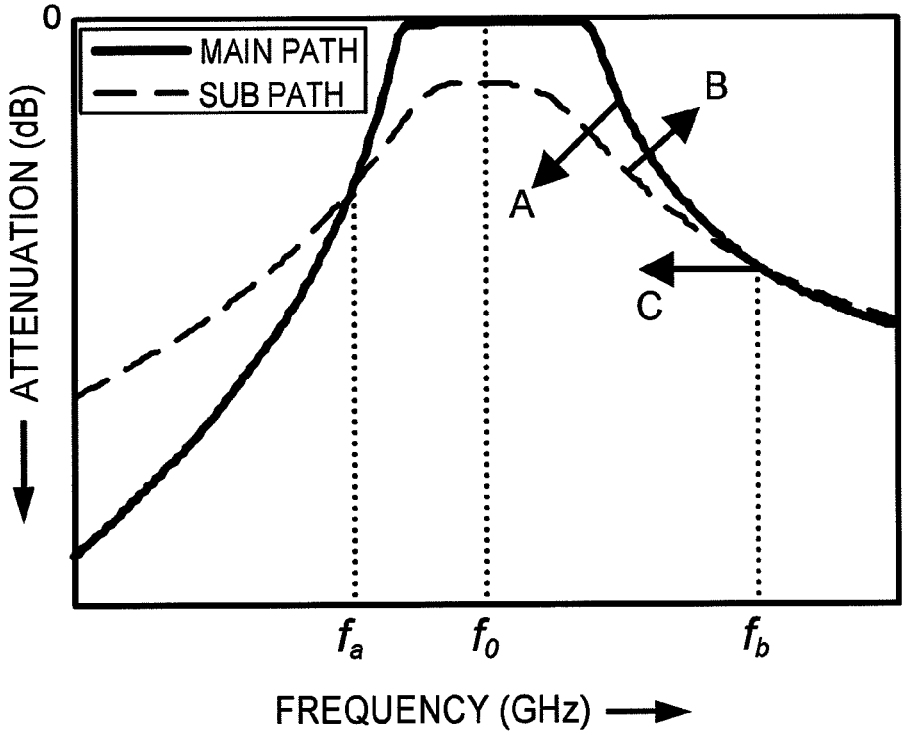
FIG. 2A is a graph illustrating respective transmission amplitude-frequency characteristics in main and sub coupling paths of the dielectric waveguide filter in FIG. 1A.
Figure 2B:
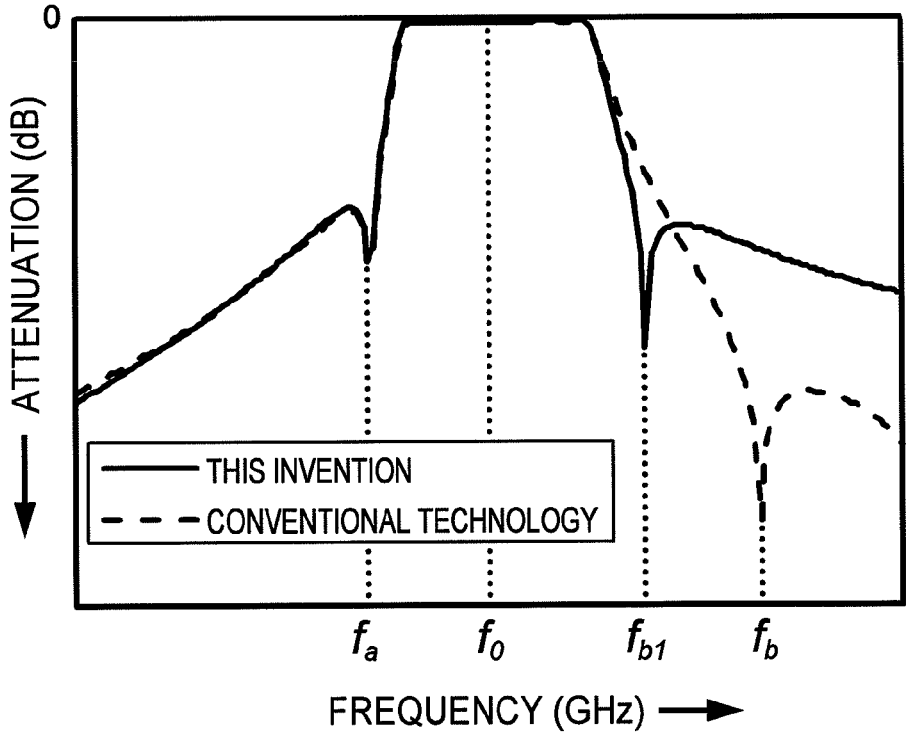
FIG. 2B is a graph illustrating respective transmission amplitude-frequency characteristics of the dielectric waveguide filter in FIG. 1A and a conventional dielectric waveguide filter.

FIG. 2A is a graph illustrating respective transmission amplitude-frequency characteristics in the main and sub coupling paths of the dielectric waveguide filter illustrated in FIG. 1A, wherein the solid line and the dashed line represent the main coupling path and the sub coupling path, respectively. FIG. 2B is a graph illustrating respective transmission amplitude-frequency characteristics of the dielectric waveguide filter illustrated in FIG. 1A and a conventional dielectric waveguide filter, wherein the solid line and the dashed line represent the dielectric waveguide filter illustrated in FIG. 1A and the conventional dielectric waveguide filter as a comparative example, respectively. In FIGS. 2A and 2B, $f_0$, $f_a$, $f_b$ and $f_{b1}$ indicate a center frequency of each filter, a low band-side attenuation pole, a high band-side attenuation pole in the conventional dielectric waveguide filter, and a high band-side attenuation pole in the dielectric waveguide filter illustrated in FIG. 1A.

In the first embodiment, each of the dielectric waveguide resonators 11 to 16 has a dielectric constant (relative permittivity) of 21. Each of the dielectric waveguide resonators 11, 16 has a width (X-axis direction) of 18 mm, a length (Y-axis direction) of 14.7 mm, and a height (Z-axis direction) of 8 mm, and each of the dielectric waveguide resonators 12, 15 has a width (X-axis direction) of 18 mm, a length (Y-axis direction) of 16.3 mm, and a height (Z-axis direction) of 8 mm. Each of the dielectric waveguide resonators 13, 14 has a width (X-axis direction) of 18 mm, a length (Y-axis direction) of 19 mm, and a height (Z-axis direction) of 8 mm. Each of the inductive windows L11, L17 has a width (X-axis direction) of 10.4 mm and a height (Z-axis direction) of 6 mm, and each of the inductive windows L12, L16 has a width (X-axis direction) of 7.3 mm and a height (Z-axis direction) of 6 mm. Each of the inductive windows L13, L15 has a width (X-axis direction) of 6.7 mm and a height (Z-axis direction) of 6 mm. The inductive window L10 has a width (Y-axis direction) of 3.2 mm and a height (Z-axis direction) of 6 mm, and the capacitive window C14 has a width (Y-axis direction) of 19 mm and a height (Z-axis direction) of 0.2 mm. The dielectric waveguide resonators 11 to 16 are arranged while allowing bottom surfaces thereof to become flush with each other, and the capacitive coupling window C14 is disposed offset toward the bottom surfaces of the dielectric waveguide resonators 13, 14.

In the dielectric waveguide filter 1 illustrated in FIG. 1A, one of a plurality of inductive coupling paths on the main coupling path, each having a high-pass filter-like property, is replaced with a capacitive coupling path having a low-pass filter-like filter. Thus, as indicated by the arrow A in FIG. 2A, a high band-side transmission amplitude in the main coupling path becomes slightly steeper, as compared to that of the conventional dielectric waveguide filter. In addition, a capacitive coupling path on the sub coupling path, having a low-pass filter-like property, is replaced with an inductive coupling path having a high-pass filter-like property. Thus, as indicated by the arrow B in FIG. 2A, a high band-side transmission amplitude in the sub coupling path becomes slightly gentle, as compared to that of the conventional dielectric waveguide filter. Therefore, a high band-side attenuation pole to be formed at a point where respective transmission amplitudes in the main and sub coupling paths are coincident with each other comes close to the center frequency $f_0$, as indicated by the arrow C in FIG. 2A. Consequently, as illustrated in FIG. 2B, the high band-side attenuation pole is set to a position corresponding to the frequency $f_{b1}$, so that it becomes possible to obtain a dielectric waveguide filter capable of preventing a high band-side attenuation characteristic from becoming gentle.

Figure 3A:
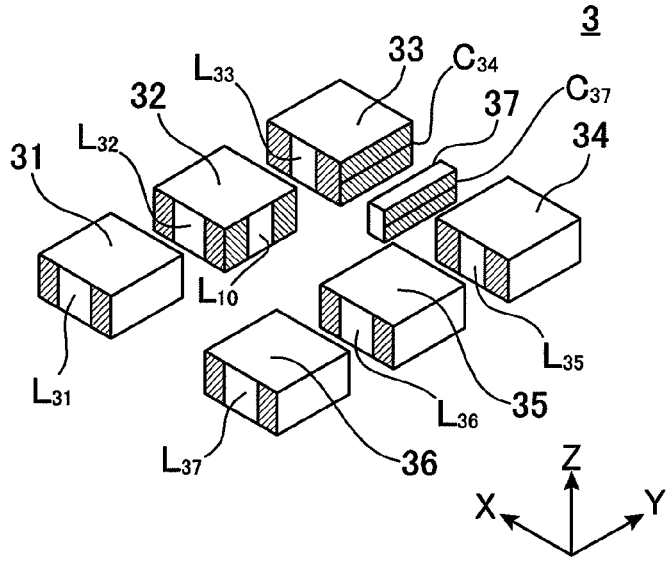
FIG. 3A is an exploded perspective view of a second embodiment of the present invention.
Figure 3B:
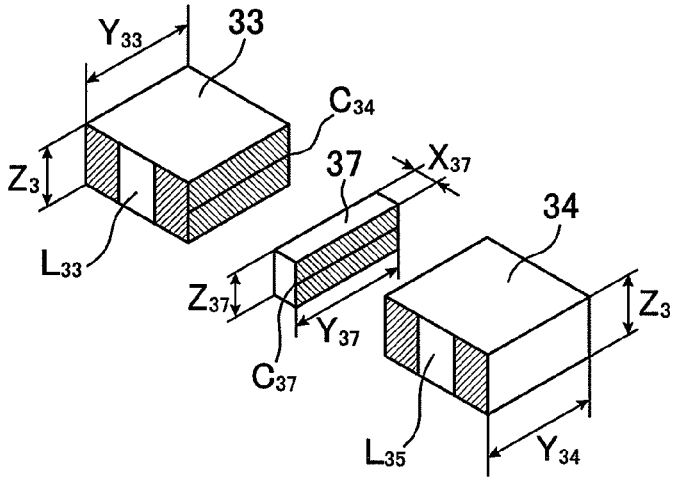
FIG. 3B is an explanatory detail diagram illustrating a part of FIG. 3A.
Figure 3C:
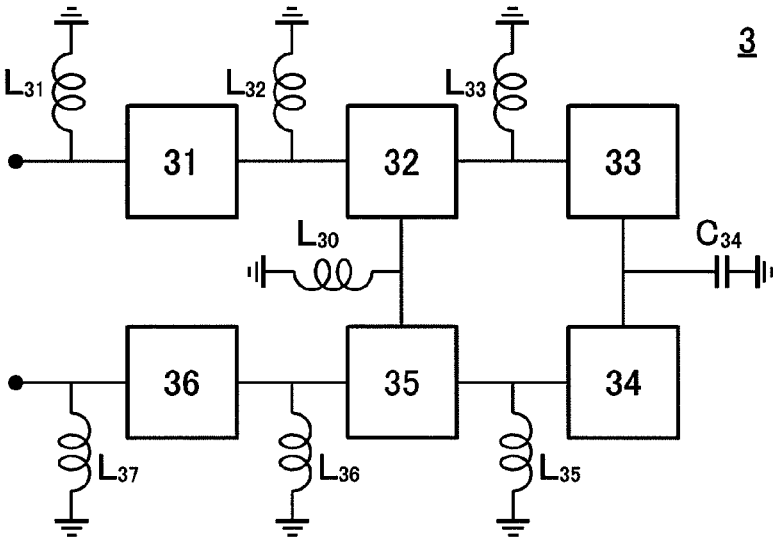
FIG. 3C is an equivalent circuit diagram corresponding to FIG. 3A.

FIG. 3A is an exploded perspective view of a dielectric waveguide filter according to a second embodiment of the present invention. FIG. 3B is an explanatory detail diagram illustrating a part of the exploded perspective view of FIG. 3A, and FIG. 3C is an equivalent circuit diagram corresponding to FIG. 3A.

As illustrated in FIGS. 3A and 3B, the dielectric waveguide filter 3 comprises six dielectric waveguide resonators 31 to 36 each having a rectangular parallelepiped-shaped dielectric block peripherally covered by a conductor film, and a dielectric plate 37 peripherally covered by a conductor film.

The dielectric waveguide resonator 31 has an inductive window L31 for input, and the dielectric waveguide resonator 36 has an inductive window L37 for output. The dielectric waveguide resonators 31 to 33 are coupled in series through inductive windows L32, L33, and the dielectric waveguide resonators 34 to 36 are coupled in series through inductive windows L35, L36. The dielectric waveguide resonators 33, 34 are coupled with each other through a capacitive window C34 while inserting the dielectric plate 37 therein, and a mutual coupling between the dielectric waveguide resonators 32, 35 is established through an inductive window L30 in a cross (bypass)-coupling manner. The dielectric plate 37 has a window C37 provided at the same position as that of the capacitive window C34 to have the same size as that of the capacitive window C34.

In the second embodiment, each of the dielectric waveguide resonators 31 to 36 has a dielectric constant (relative permittivity) of 21. Each of the dielectric waveguide resonators 31, 36 has a width (X-axis direction) of 18 mm, a length (Y-axis direction) of 14.8 mm, and a height (Z-axis direction) of 8 mm, and each of the dielectric waveguide resonators 32, 35 has a width (X-axis direction) of 19.9 mm, a length (Y-axis direction) of 15 mm, and a height (Z-axis direction) of 8 mm. Each of the dielectric waveguide resonators 33, 34 has a width (X-axis direction) of 18.3 mm, a length (Y-axis direction) of 18 mm, and a height (Z-axis direction) of 8 mm. Each of the inductive windows L31, L37 has a width (X-axis direction) of 10.4 mm and a height (Z-axis direction) of 6 mm, and each of the inductive windows L32, L36 has a width (X-axis direction) of 7.3 mm and a height (Z-axis direction) of 6 mm. Each of the inductive windows L33, L35 has a width (X-axis direction) of 6.5 mm and a height (Z-axis direction) of 6 mm. The inductive window L30 has a width (Y-axis direction) of 4.7 mm and a height (Z-axis direction) of 6 mm. The dielectric plate 37 has a width (Y-axis direction) of 18 mm, a thickness (X-axis direction) of 2 mm, and a height (Z-axis direction) of 5.3 mm. The capacitive window C34 has a width (Y-axis direction) of 13 mm and a height (Z-axis direction) of 2.3 mm, and a center of the capacitive window C34 is coincident with a center of a side surface (Y-Z plane) of the dielectric plate 37. The dielectric waveguide resonators 31 to 36 are arranged while allowing bottom surfaces thereof to become flush with each other.

A width Y37 of the dielectric plate 37 is not necessarily set to a value equal to a width Y33 of the dielectric waveguide resonator 33 or a width Y34 of the dielectric waveguide resonator 34. Further, a height Z37 of the dielectric plate 37 is not necessarily set to a value equal to a height Z3 of each of the adjacent dielectric waveguide resonators 33, 34.

Figure 4:
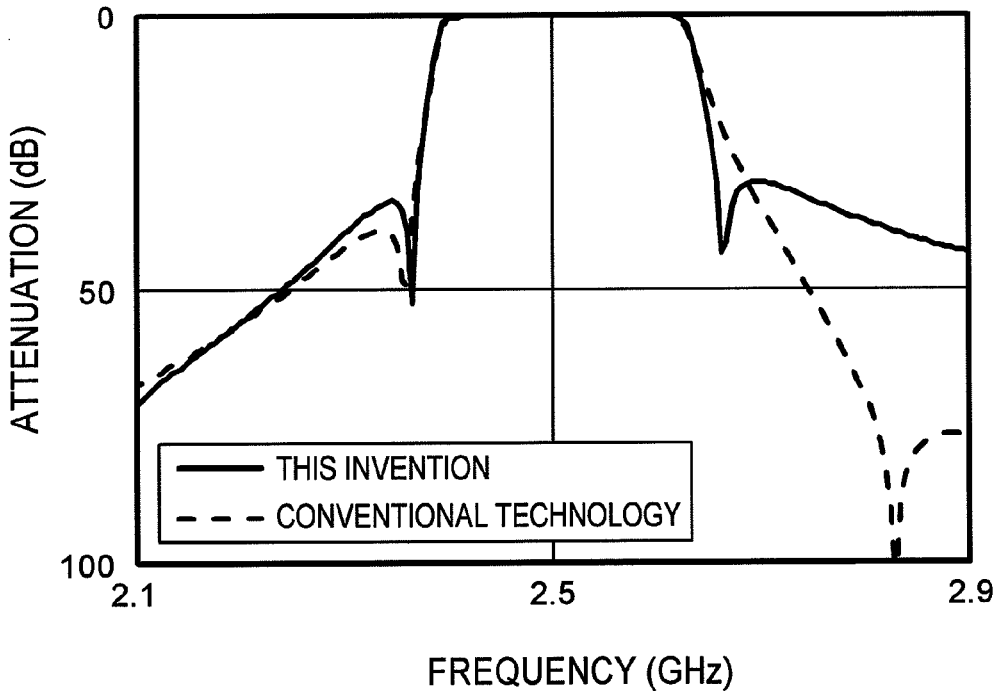
FIG. 4 is a graph illustrating a frequency characteristic of the dielectric waveguide filter in FIG. 3A.

FIG. 4 is a graph illustrating a frequency characteristic of the dielectric waveguide filter 3 illustrated in FIG. 3A, wherein the solid line and the dashed line represent the dielectric waveguide filter 3 illustrated in FIG. 3A and the conventional dielectric waveguide filter as a comparative example, respectively. FIG. 4 shows that the dielectric waveguide filter having the dielectric plate inserted in the capacitive coupling path can also obtain a steep, high band-side attenuation characteristic.

Meanwhile, in cases where respective coupling coefficients of a capacitive window and an inductive window are approximately equal to each other, a distance between opposed sides of the capacitive window in a short-side direction thereof becomes significantly shorter than a distance between opposed sides of the inductive window in a short-side direction thereof.

Further, in the dielectric waveguide filter 1 illustrated in FIG. 1A, a transmission amplitude in the main coupling path is greater than that in the sub coupling path, in a passband of the filter, so that most of electric power passes through the main coupling path.

Therefore, in a situation where a large amount of electric power is input into a dielectric waveguide filter using a capacitive window in a part of a main coupling path, electric discharge is likely to occur in the capacitive window C14 due to concentration of an electric field thereon, resulting in deterioration of power endurance characteristics.

In order to solve the above problem, in the dielectric waveguide filter 3 illustrated in FIG. 3A, a dielectric plate 37 having a dielectric constant greater than that of each of the dielectric waveguide resonators is inserted in the capacitive coupling path.

Figure 5A:
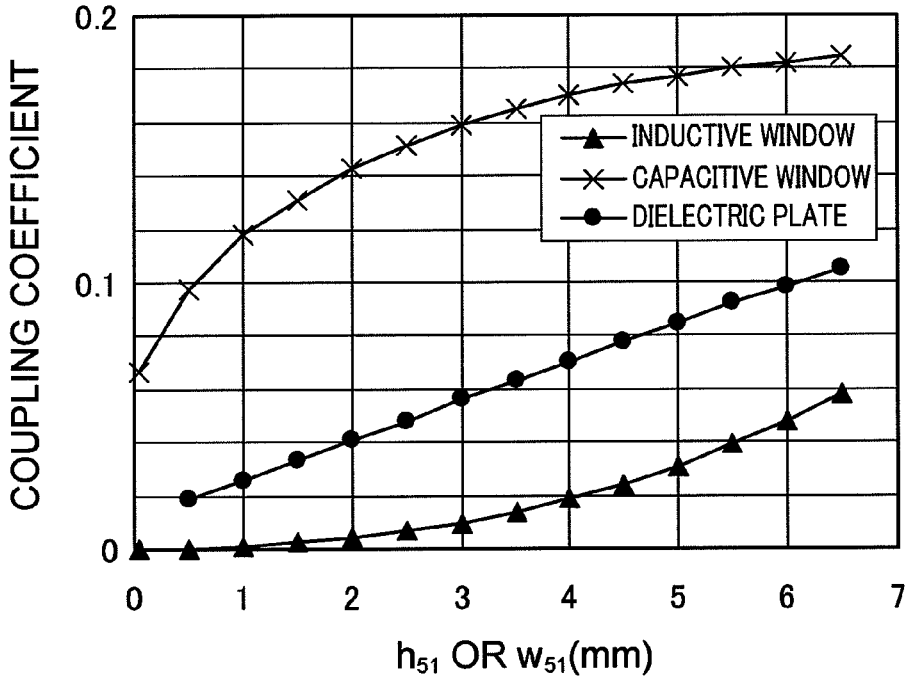
FIG. 5A is a graph illustrating a relationship between a window size and a coupling coefficient.
Figure 5B:
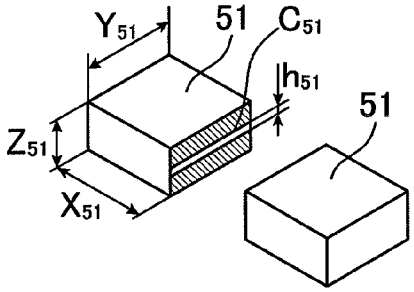
FIG. 5B is an explanatory diagram of a configuration of a dielectric waveguide resonator indicated by the mark x in FIG. 5A.
Figure 5C:
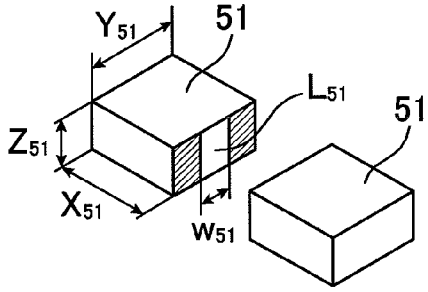
FIG. 5C is an explanatory diagram of a configuration of a dielectric waveguide resonator indicated by the mark ▲ in FIG. 5A.
Figure 5D:
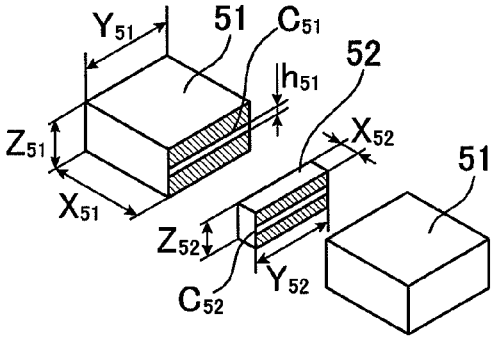
FIG. 5D is an explanatory diagram of a configuration of a dielectric waveguide resonator indicated by the mark ● in FIG. 5A.

FIG. 5A is a graph illustrating a relationship between a window size and a coupling coefficient, in each coupling structure where two dielectric waveguide resonators are coupled together as illustrated in FIGS. 5B to 5D. In FIG. 5A, the vertical axis represents a coupling coefficient, and the horizontal axis represents a window size. The mark x indicates a coupling coefficient with respect to a height h51 of a capacitive window C51, in the structure where two dielectric waveguide resonators 51, 51 are coupled through the capacitive window C51, as illustrated in FIG. 5B. The mark ▲ indicates a coupling coefficient with respect to a width w51 of an inductive window L51, in the structure where the two dielectric waveguide resonators 51, 51 are coupled through the inductive window L51, as illustrated in FIG. 5C. The mark ● indicates a coupling coefficient with respect to the height h51 in the window size of the capacitive window C51, in the structure where the two dielectric waveguide resonators 51, 51 are coupled through the capacitive window C51 having the dielectric plate 52 inserted therein, as illustrated in FIG. 5D.

Each of the dielectric waveguide resonators 51, 51 has a dielectric constant (relative permittivity) of 21. The dielectric waveguide resonator 51 has a width Y51 of 18 mm and a height Z51 of 8 mm, and is adapted to resonate in a fundamental mode (TE101). The dielectric waveguide resonator 51 has a resonant frequency of 2.5 GHz, and a length X51 thereof is determined by the resonant frequency.

The dielectric plate 52 has a dielectric constant (relative permittivity) of 91. The dielectric plate 52 is peripherally covered by a conductor film, except for a region corresponding to a window C52 thereof. The dielectric plate 52 has a thickness X52 of 2 mm, a width Y52 of 18 mm and a height Z52 greater than the height h51 of the capacitive window C51 by 1 mm. The window C52 has the same size as that of the capacitive window C51.

As is clear from FIG. 5A, for example, in cases where a desired coupling coefficient is 0.08, the height of the capacitive window is about 0.2 mm, whereas, when the dielectric plate is inserted, the height of the capacitive window can be increased to about 4.7 mm. Thus, electric discharge becomes less likely to occur in the capacitive window, which provides improved power endurance characteristics.

In the dielectric waveguide filter 3 illustrated in FIG. 3A, it is necessary that the dielectric plate 37 has a dielectric constant greater than that of the dielectric block of the dielectric waveguide resonator, and the dielectric plate 37 has a thickness X37 which is less than one-fourth a guide wavelength (in-waveguide wavelength) of the dielectric plate 37 in a thickness direction (X-axis direction) thereof. The reason is as follows.

Figure 6A:
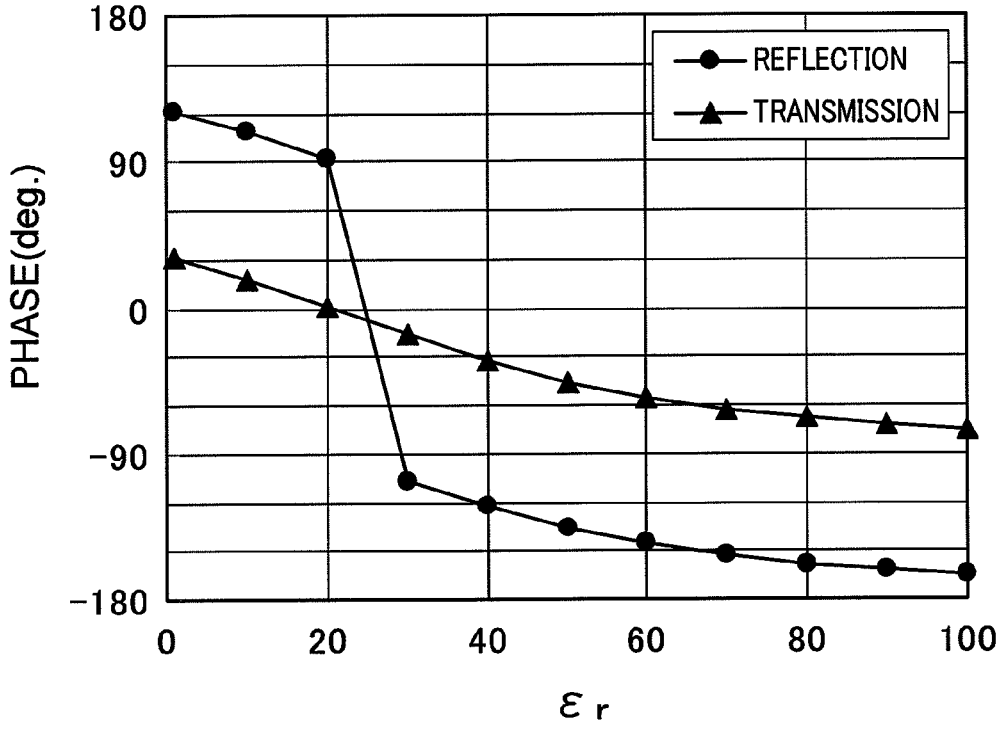
FIG. 6A is a graph illustrating a transmission phase and a reflection phase with respect to a dielectric constant of a dielectric plate in FIG. 5D.
Figure 6B:
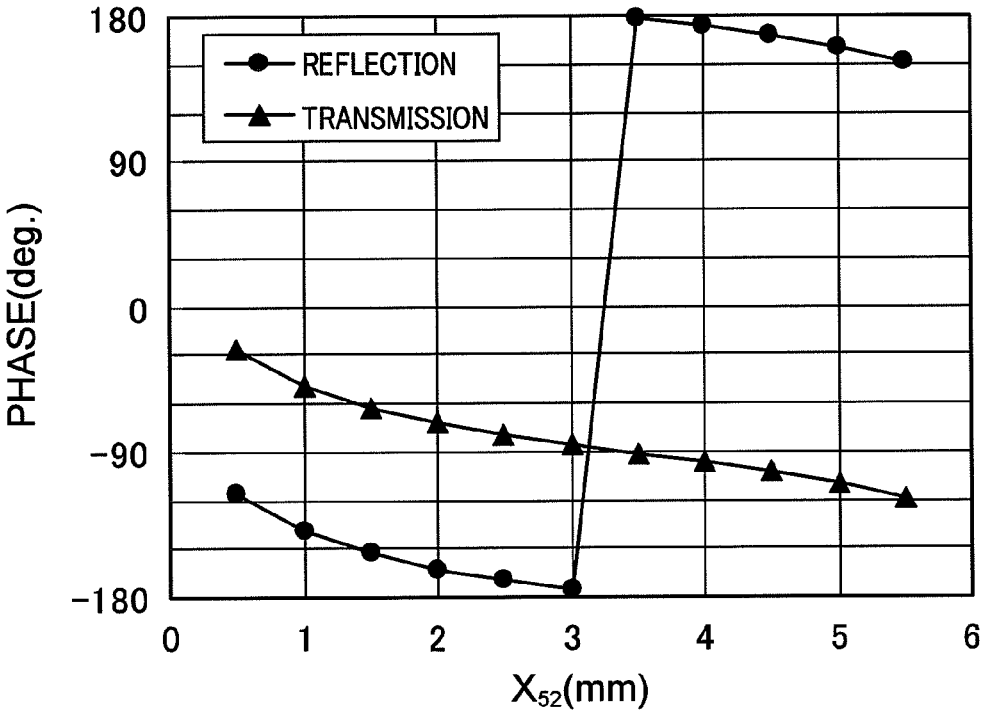
FIG. 6B is a graph illustrating a transmission phase and a reflection phase with respect to a thickness of the dielectric plate in FIG. 5D.

FIG. 6A is a graph illustrating a relationship between a reflection phase and a transmission phase when a dielectric constant $\in_r$ of the dielectric plate 52 is variously changed in the structure illustrated in FIG. 5D, and FIG. 6B is a graph illustrating a relationship between a reflection phase and a transmission phase when the thickness X52 of the dielectric plate 52 is variously changed in the structure illustrated in FIG. 5D. In FIGS. 6A and 6B, the mark ● indicates a reflection phase, and the mark ▲ indicates a transmission phase.

As seen in FIG. 6A, when the dielectric constant of the dielectric plate is equal to or less than 21 which is a dielectric constant of the dielectric waveguide resonator, the transmission phase is deviated from the range of 0 to −90 degrees, and the reflective phase has a positive sign.

Further, as seen in FIG. 6B, when the thickness of the dielectric plate is equal to or greater than 3.5 mm which is one-fourth the guide wavelength of the dielectric plate in the thickness direction thereof, the transmission phase is deviated from the range of 0 to −90 degrees, and the reflective phase has a positive sign. The above phenomena mean that a coupling between the dielectric waveguide resonators is no longer a capacitive coupling.

Therefore, it is necessary that the dielectric plate has a dielectric constant greater than that of the dielectric waveguide resonator, and the dielectric plate has a thickness which is less than one-fourth the guide wavelength of the dielectric plate in the thickness direction thereof.

Figure 7A:
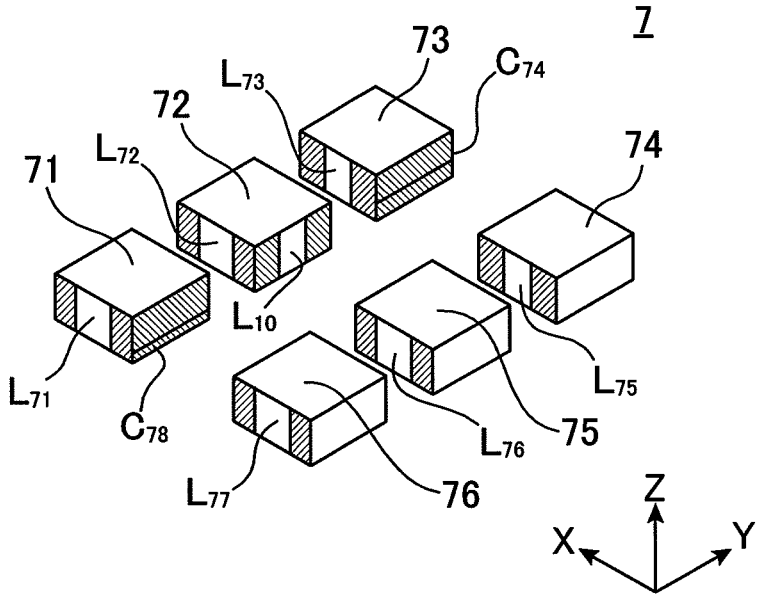
FIG. 7A is an exploded perspective view of a third embodiment of the present invention.
Figure 7B:
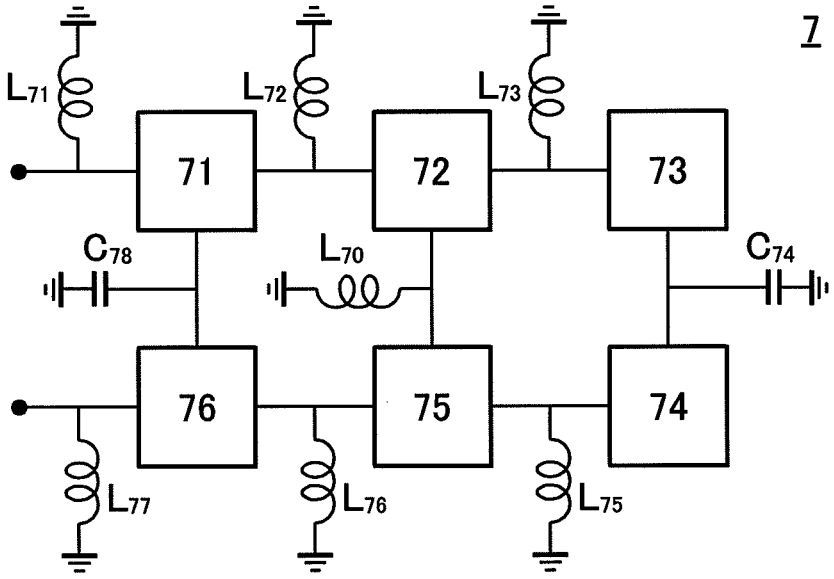
FIG. 7B is an equivalent circuit diagram corresponding to FIG. 7A.
Figure 8A:
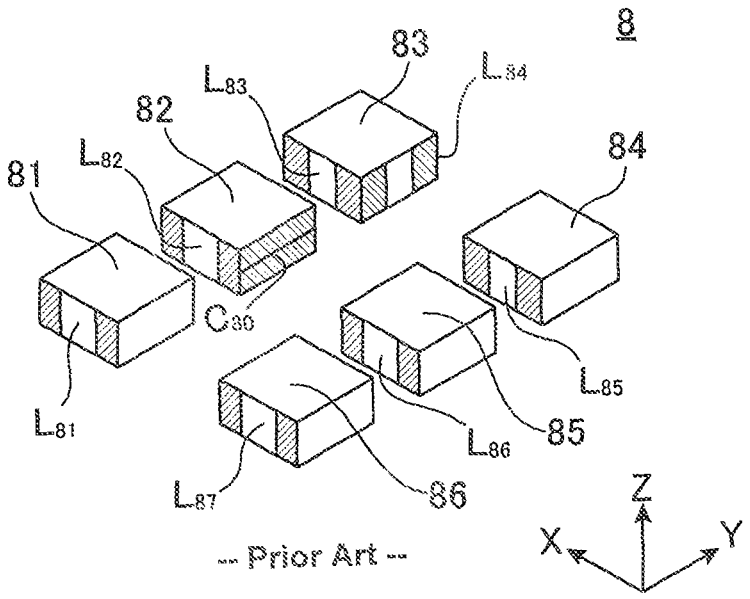
FIG. 8A is an exploded perspective view of a conventional dielectric waveguide filter.
Figure 8B:
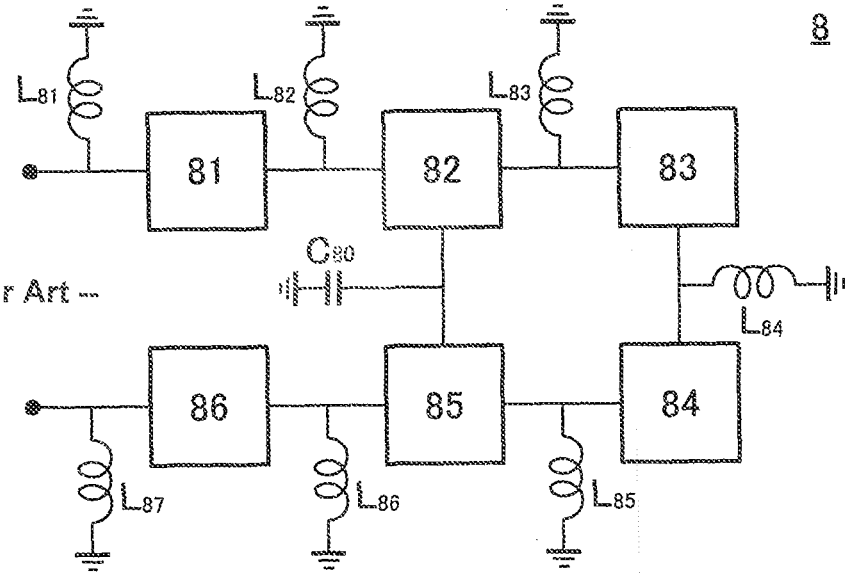
FIG. 8B is an equivalent circuit diagram corresponding to FIG. 8A.
Figure 9A:
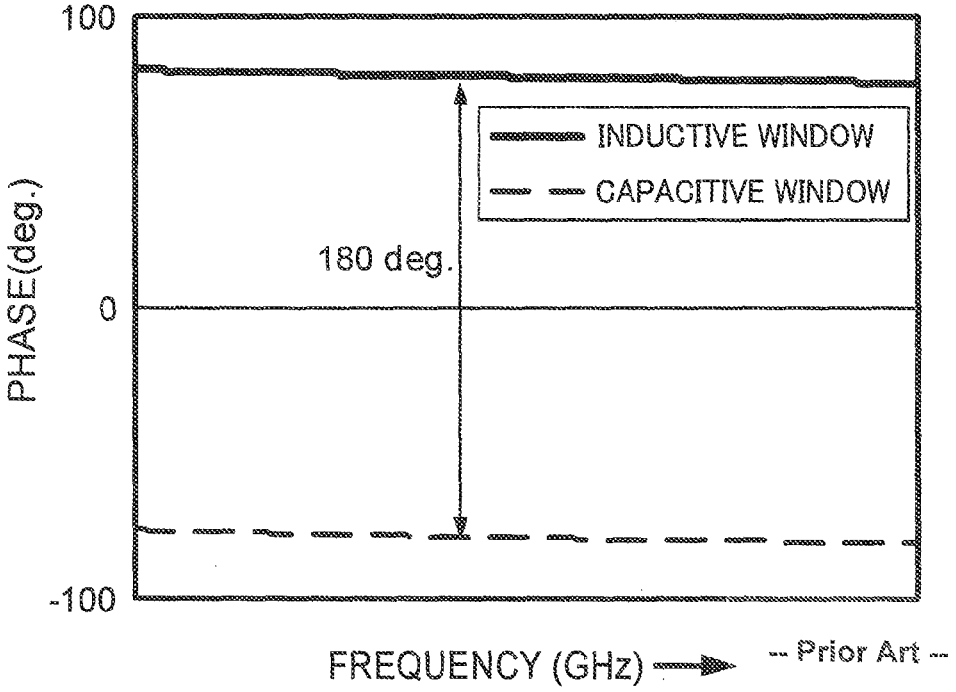
FIG. 9A is a graph illustrating a frequency characteristic of transmission phase with respect to frequency of an inductive coupling path and a capacitive coupling path.
Figure 9B:
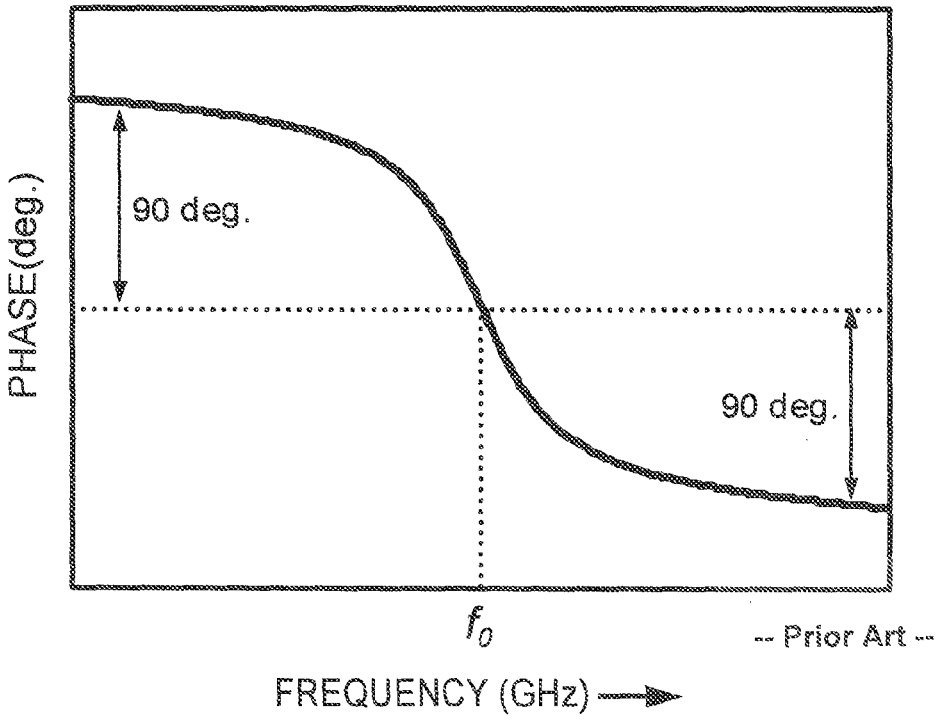
FIG. 9B is a graph illustrating a frequency characteristic of transmission phase with respect to frequency of a dielectric waveguide resonator
Figure 10A:
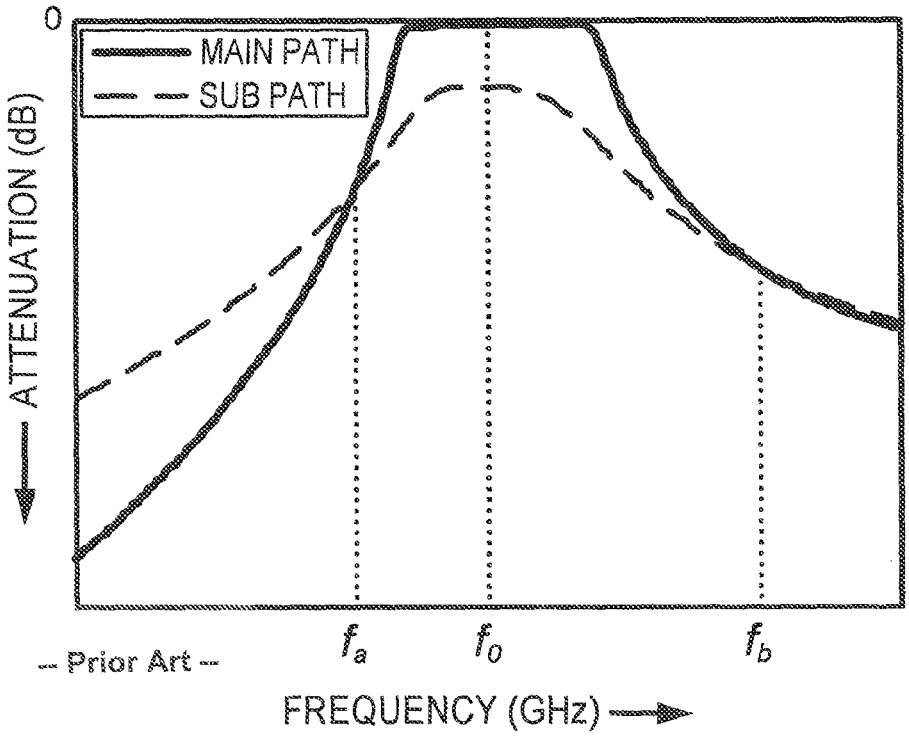
FIG. 10A is a graph illustrating respective transmission amplitude-frequency characteristic in the main and sub coupling paths of the conventional dielectric waveguide filter.
Figure 10B:
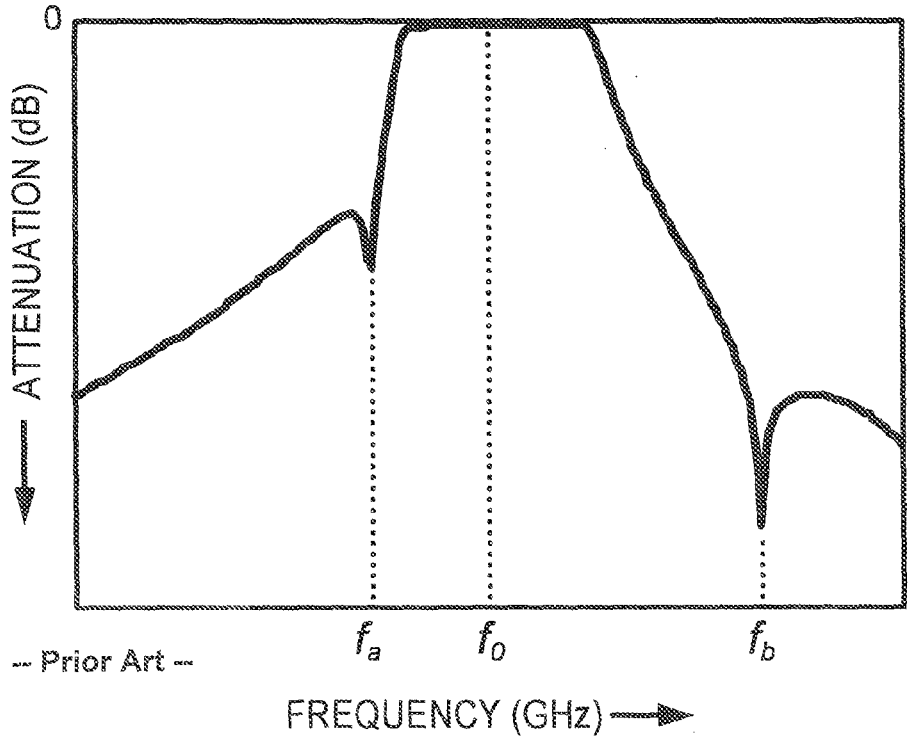
FIG. 10B is a graph illustrating a transmission amplitude-frequency characteristic of the conventional dielectric waveguide filter.
Figure 11:
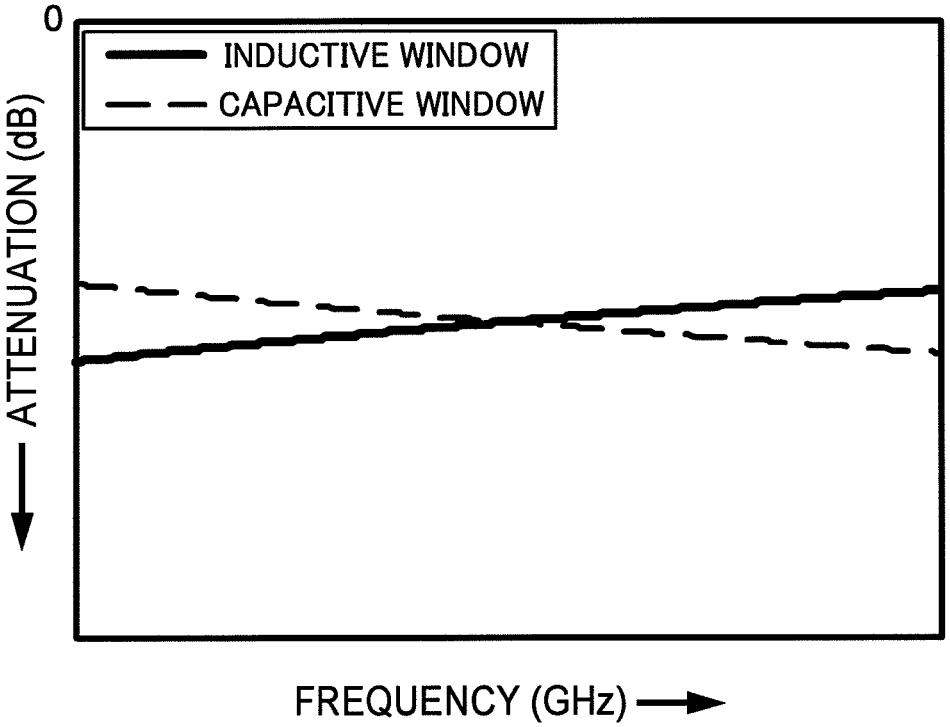
FIG. 11 is a graph illustrating respective transmission amplitude-frequency characteristic in a capacitive coupling path and an inductive coupling path.

FIG. 7A is an exploded perspective view of a dielectric waveguide filter according to a third embodiment of the present invention, and FIG. 7B is an equivalent circuit diagram corresponding to FIG. 7A.

As illustrated in FIGS. 7A and 7B, the dielectric waveguide filter 7 has a main coupling path passing through dielectric waveguide resonators 71, 72, 73, 74, 75, 76, a first sub coupling path passing through the dielectric waveguide resonators 71, 72, 75, 76, and a second sub coupling path passing through the dielectric waveguide resonators 71, 76.

Even when there are two or more sub coupling paths as in the third embodiment, at least one capacitive coupling path may be provided on the main coupling paths, and a capacitive coupling path may be provided on one of the sub coupling paths. Further, the dielectric plate as illustrated in the second embodiment may be inserted in the capacitive coupling path.

As described above, in the dielectric waveguide filter of the present invention, a capacitive coupling path is used for at least one coupling between dielectric waveguide resonators in a part of a main coupling path bypassed by a cross-coupling, so that it becomes possible to provide a steep attenuation characteristic on a high frequency side of a passband In addition, a distance between opposite sides of a capacity window in a short-side direction thereof can be increased by inserting a dielectric plate in the capacitive coupling path. This makes it possible to provide improved power endurance characteristics.

EXPLANATION OF CODES

1, 3, 7, 8: dielectric waveguide filter
11 to 16, 31 to 36, 51, 71 to 76, 81 to 86: dielectric waveguide resonator
37, 52: dielectric plate
L10 to L13, L15 to L17, L30 to L33, L35 to L37, L51, L70 to L73, L75 to L77, L81 to L87: inductive window
C14, C34, C51, C74, C78, C80: capacitive window
C37, C52: window

What is claimed is:

1. A dielectric waveguide filter containing a plurality of coupled dielectric waveguide resonators each having a rectangular parallelepiped-shaped dielectric block, a periphery of the dielectric block being covered by a conductor film and the dielectric block being partially provided with a coupling window through which the dielectric is exposed, the dielectric waveguide filter comprising:

a main coupling path coupling the plurality of dielectric waveguide resonators in series with one of (i) an inductive coupling window and (ii) a capacitive coupling window; and at least one sub coupling path with another inductive window formed by bypassing a part of the main coupling path;

wherein the part of the main coupling path bypassed by the sub coupling path includes at least one capacitive coupling path with the capacitive coupling window.

2. The dielectric waveguide filter as defined in claim 1, wherein the at least one capacitive coupling path has a dielectric plate inserted therein, wherein a periphery of the dielectric plate is covered by a conductor film, the dielectric plate is partially provided with a coupling window through which the dielectric is exposed, and the dielectric plate has a dielectric constant greater than that of the plurality of coupled dielectric waveguide resonators.

3. The dielectric waveguide filter as defined in claim 2, wherein the dielectric plate has a thickness which is less than one-fourth of a guide wavelength in a thickness direction of the dielectric plate.

* * * * *